US011300297B2

(12) United States Patent
Hatley

(10) Patent No.: US 11,300,297 B2
(45) Date of Patent: Apr. 12, 2022

(54) FIRE FIXTURE FOR HOT TUB

(71) Applicant: LPI, Inc., Johnson City, TN (US)

(72) Inventor: David E. Hatley, Gray, TN (US)

( * ) Notice: Subject to any disclaimer, the term of this patent is extended or adjusted under 35 U.S.C. 154(b) by 8 days.

(21) Appl. No.: 17/069,346

(22) Filed: Oct. 13, 2020

(65) Prior Publication Data

US 2021/0088218 A1 Mar. 25, 2021

Related U.S. Application Data

(63) Continuation-in-part of application No. 16/182,998, filed on Nov. 7, 2018, now abandoned.

(60) Provisional application No. 62/582,533, filed on Nov. 7, 2017.

(51) Int. Cl.

| | |
|---|---|
| ***F24B 1/195*** | (2006.01) |
| ***F24B 1/199*** | (2006.01) |
| ***E04H 4/14*** | (2006.01) |
| ***A61H 33/00*** | (2006.01) |

(52) U.S. Cl.

CPC ..... *F24B 1/195* (2013.01); *A61H 33/0087* (2013.01); *E04H 4/148* (2013.01); *F24B 1/199* (2013.01)

(58) Field of Classification Search

CPC ..... A61H 33/0087; A61H 33/0095; F16M 13/022; F23D 14/38

USPC ..... 4/546

See application file for complete search history.

(56) References Cited

U.S. PATENT DOCUMENTS

| | | | | |
|---|---|---|---|---|
| 547,038 | A | 10/1895 | Slowey et al. | |
| 1,450,444 | A | 8/1922 | McGuire | |
| 4,455,997 | A | 6/1984 | Evans et al. | |
| 4,529,033 | A | 7/1985 | Blum | |
| 4,679,545 | A | 7/1987 | Cavestany | |
| 4,893,609 | A | 1/1990 | Giordani et al. | |
| 5,158,069 | A | 10/1992 | Hamos | |
| 5,201,307 | A | 4/1993 | Afshar | |
| 5,318,007 | A | 6/1994 | Afshar | |
| 5,961,042 | A * | 10/1999 | Doyle | F23N 1/002 239/12 |
| 6,581,217 | B2 | 6/2003 | Marcos | |
| 6,754,916 | B1 | 6/2004 | Cox | |
| 7,055,186 | B2 * | 6/2006 | Lauter | A61H 33/0087 4/541.1 |
| 7,162,753 | B2 | 1/2007 | Khosropour et al. | |
| 8,572,769 | B2 | 11/2013 | Gamracy et al. | |
| 8,881,719 | B2 | 11/2014 | Pleva | |
| 2005/0145710 | A1 * | 7/2005 | Bennett | F23D 14/38 239/18 |

* cited by examiner

*Primary Examiner* — Christine J Skubinna

(74) *Attorney, Agent, or Firm* — Blanchard & Associates

(57) ABSTRACT

A hot tub including a hot tub basin with a plurality of seats formed therein, the hot tub basin configured to hold and recirculate water, a housing surrounding the hot tub basin, and one or more fire fixtures provided proximate an upper portion of the hot tub basin to selectively produce open flame.

21 Claims, 4 Drawing Sheets

FIRE FIXTURE FOR HOT TUB

CROSS-REFERENCE TO RELATED APPLICATIONS

This application is a continuation-in-part of U.S. patent application Ser. No. 16/182,998, filed on Nov. 7, 2018, which claimed the benefit of U.S. Provisional Patent Application Ser. No. 62/582,533, filed on Nov. 7, 2017, the contents of which are incorporated herein in their entirety by reference.

FIELD OF INVENTION

The present general inventive concept relates to ambient fixtures for hot tubs, and, more particularly, to an open fire device to enhance the aesthetics and enjoyment of hot tubs.

BACKGROUND

Hot tubs and similar devices are used for recreation, exercise, and physical therapy. Hot tubs are often employed for treating sore muscles or for relaxation after exercise or rigorous physical activity.

Use of hot tubs often occurs out of doors and after dark. For reasons of safety and convenience, lighting systems are often mounted in hot tubs. Such lighting systems help to create a positive atmosphere or ambience, which may change as a function of the brightness of the lights, the types and colors of the lights, the number of light sources, and the location of the light sources relative to the users. With the current popularity of firepits and chimney-less fireplaces, a hot tub with such a fire fixture to take the place of, or to supplement, ambient lighting may be desired.

BRIEF SUMMARY

According to various example embodiments of the present general inventive concept, a hot tub is provided with a fire producing fixture to provide a controlled flame to enhance the ambience of the hot tub.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a hot tub including a hot tub basin with a plurality of seats formed therein, the hot tub basin configured to hold and recirculate water, a housing surrounding the hot tub basin, and one or more fire fixtures provided proximate an upper portion of the hot tub basin to selectively produce open flame.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
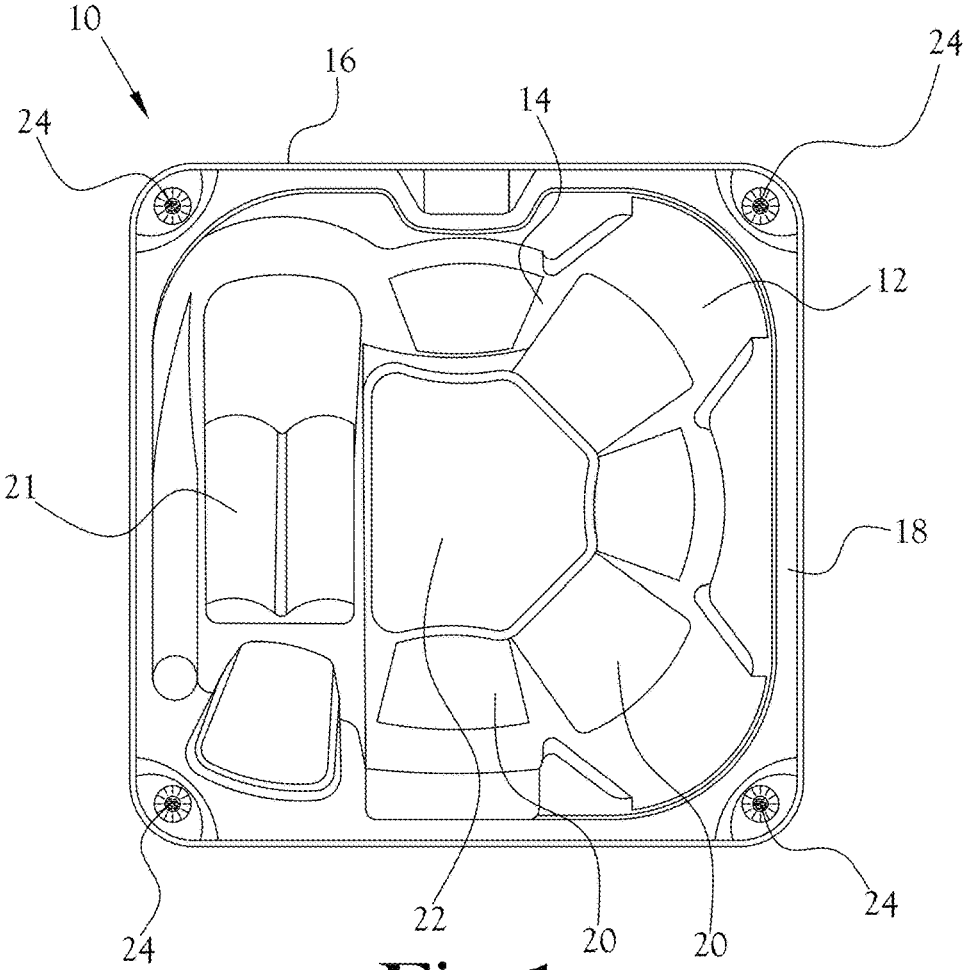
FIG. 1 illustrates a hot tub provided with fire fixtures according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a hot tub is provided with one or more fire fixtures to improve the overall ambience and aesthetics of the hot tub experience. The "fire fixtures" referred to herein may refer to a host of different devices for producing open flames, such as gas fireplaces, electric fireplaces, ethanol fireplaces, gel fireplaces, and so on. Ethanol fireplaces, in particular, are described in most of the following example embodiments, but it is understood that various example embodiments of the present general inventive concept are not limited to such a fire fixture. Also, the fire fixtures generally described herein may be installed in the hot tub during the construction of the hot tub, or one or more areas in the hot tub may be configured to receive aftermarket purchased fire fixtures.

Ethanol type fire fixtures are increasingly popular for their ease of use. A low amount of heat is generated from ethanol fire fixtures, which produce real flames, and, unlike burning wood or some other substances, no dangerous fumes are produced. For this reason, no type of chimney is needed, as the fuel is clean enough that the fire merely produces small amounts of water and carbon dioxide. In fact, ethanol fire fixtures may be used inside the home without chimney or worry, and are therefore ideal for controlled flames around a hot tub. Some types of ethanol fire fixtures have fuel reservoirs simple enough to merely pour the fuel inside and light the fixture. While the exact components of such fire fixtures may vary depending on the type of fixture in question, some standard features of an ethanol fire fixture are the device body, accessories such as fire glass, rocks, and ceramic logs for appearance, and a burner-pot to hold the ethanol. In various example embodiments of the present general inventive concept, the fire fixtures may be fixed in the body of the hot tub, may be selectively removable, may be manually or automatically retractable inside the body of the hot tub, and so on.

FIG. 1 illustrates a hot tub provided with fire fixtures according to an example embodiment of the present general inventive concept. As illustrated in FIG. 1, two basic components of the hot tub 10 are the basin 12 or shell, which forms an interior well 14 and holds the hot tub 10 water, and the housing 16, which forms a frame structure that surrounds the basin 12 and encloses most of the inner workings of the hot tub 10. In the example embodiment of the hot tub 10 illustrated in FIG. 1, an upper perimeter 18 of the basin 12 extends substantially horizontally to meet the housing 16, forming a substantially flat area around the top of the hot tub 10. A plurality of seats 20,21 are formed about the inner part of the basin 12. In the example embodiment illustrated in FIG. 1, a reclining seat 21 is formed along one side of the basin 12, and a number of upright seats 20 are provided around the rest of the basin 12. The center of the hot tub basin 12 is a lowered area forming a floor surface 22 on which the feet of people in the standard seats 20 may rest. It is understood that this is merely one example embodiment of the arrangement of a hot tub basin 12, and various other example embodiments may have a variety of different numbers, types, configurations, etc., of seats formed in or on the basin 12 for the enjoyment of the user.

In the example embodiments illustrated in FIG. 1 a plurality of fire fixtures 24 are provided to the hot tub 10 in such a configuration that one fire fixture 24 is provided proximate each corner of the hot tub basin 12. In various example embodiments, the fire fixtures 24 may be provided at portions of the housing 16, such as in hot tub configurations in which the basin 16 does not extend all of the way to the edge of the hot tub. Although the fire fixtures 24 provided to each corner of the hot tub basin 12 in FIG. 1 are illustrated as being substantially round, most any shape of fire fixture may be used in various example embodiments of the present general inventive concept. In various example embodiments, the fire fixtures 24 may rest and/or be operated at a level nearly flush with the upper housing or upper perimeter 18 of the basin 12 of the hot tub 10, so that only the upper part of the fire fixtures 24 are visible to users of the hot tub 10. In other various example embodiments, the fire fixtures 24 may be operated at a higher level above the upper perimeter 18 of the basin 12 of the hot tub 10 to avoid any complications like splashing water, or coming into contact with the hair of the hot tub users, and so on. Also, while the fire fixtures 24 are shown as being provided in or proximate to each corner of the basin 12 of the hot tub 10 in the example embodiment illustrated in FIG. 1, it is understood that other various example embodiments of the present general inventive concept may provide fewer or more of the fire fixtures 24, and which may be located at various points on or around the basin 12 of the hot tub 10. For example, a tray-type fixture may be provided alongside an outer edge of the basin 12, and that portion of the basin 12 may extend away from the seating area of the hot tub to provide more distance between the fire fixture 24 and users/water.

In various example embodiments of the present general inventive concept, the fire fixtures 24 provided to the hot tub may be fixed in place. In such a configuration, some example embodiments may include covers to place over the fire fixture 24 for protection when the fire fixture 24 is not in use. In some example embodiments of the present general inventive concept the fire fixtures may be selectively removable so that a user can install the fire fixtures 24 to the hot tub only when desired. In such example embodiments, the hot tub may be provided with cover plates or other such selectively removable decorative or functional items that can be selectively placed in or over the portions designed to receive the removable fire fixtures 24, so that the portions of the hot tub designed to receive the selectively removable fire fixtures 24 may be disguised or altogether hidden from view. In various example embodiments in which the fire fixtures 24 are selectively removable, the fire fixtures may rest freely in their corresponding receiving portions 25, or may be secured by a friction fit, which allows height adjustment of the fixture 24, as illustrated in FIG. 2B, or other type of fixing configuration, and so on. In various example embodiments of the present general inventive concept the fire fixtures 24 may be retractable inside the body of the hot tub 10, e.g., under the basin 12 or just below a top surface of the basin 12. For example, as illustrated in FIGS. 2A-2D, the fire fixtures 24 may be pushed down manually into a receiving portion 25 interior so as to be flush or below a surface of the basin 12, and may be manually released by such methods as simply pulling the fixture up and into place, a spring-loaded configuration 31 which raises the fire fixture (and which may be mechanically regulated to move slowly into place for a smooth installation action), an automatic gear 35, such as, for example, a gear tooth wheel and rail, or other such system to raise the fire fixtures into place at the touch of a button (or by interaction with a touchpad, smart phone application, etc.), and so on. Such spring-loaded configuration 31 actions are well known, such as ones having a catch that actuates when the spring-loaded body is moved to a first position at which the spring is compressed, and that releases in response to the body then being pressed again to allow the regulated spring-loaded movement of the body to a position of use at which the spring is not as compressed as the first position, and are therefore not discussed in detail here. The components of the spring-loaded mechanism/configuration 31 may be based on an underside of the basin 12, and/or an inner surface of the housing 16. Cover plates 33 may be provided to move into place (by hinged action, slide action, so on), when the fire fixtures are retracted, and to move out of the way when the fire fixtures are protracted. Such cover plates 33 may themselves be retractable to a position below the shell 12 when the fire fixtures 24 are exposed, or may remain exposed in an open state when the fire fixtures 24 are exposed. In various example embodiments.

In various example embodiments of the present general inventive concept, the fire fixtures 24 may be fueled by pouring the fuel into an open reservoir easily accessible in the fire fixtures 24, by fuel lines connected to a fuel reservoir located inside or near the hot tub 10, by fuel lines connected to a fuel supply located remotely from the hot tub 10, and so on. In various example embodiments of the present general inventive concept the fire fixtures 24 may by equipped with fuel reservoirs that prevent release of the fuel when the fuel fixtures 24 are retracted. For example, if the fire fixtures 24 are retracted under the basin 12 of the hot tub in a folding or flipping movement, the fuel reservoir may be configured to close either manually or automatically, or by a self-sealing design, to prevent the spillage or evaporation of the fuel. In various example embodiments of the present general inventive concept, the fire fixtures 24 may be configured to be self-igniting so as to start when they reach the fully protracted position. In various example embodiments in which the fire fixtures 24 are selectively removable from the hot tub 10, a storage space may be provided in the hot tub housing 16 to securely stow away the fire fixtures. For example, an access door may be provided so that a user can access a storage space configured to hold the fire fixtures 24 upright in a secured manner.

In various example embodiments of the present general inventive concept, the fire fixtures 24 may be raised and lowered to a plurality of selectable heights, either manually or automatically, to provide the flames at a desired height near the top of the hot tub housing 16 or one or more positions higher above the hot tub for safety and/or aesthetic reasons.

Figure 2A:
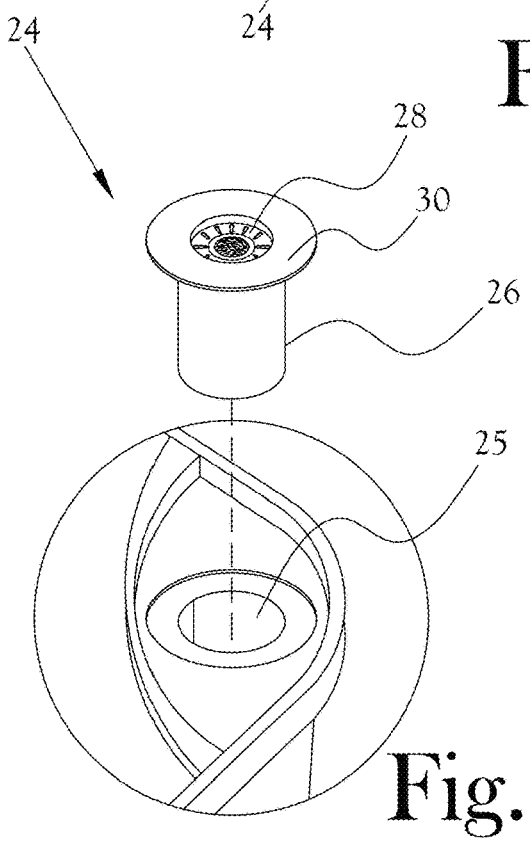
FIGS. 2A-D illustrate example embodiments of a fire fixture for use with the hot tub illustrated in FIG. 1.
Figure 2B:
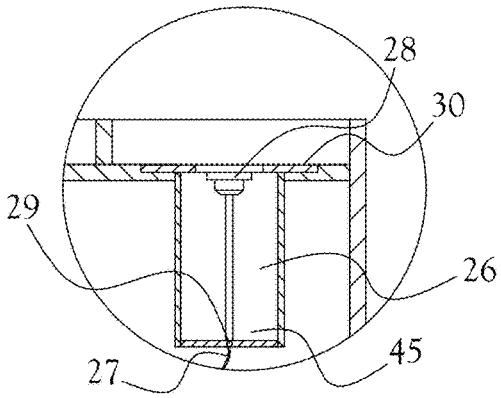
Figure 2C:
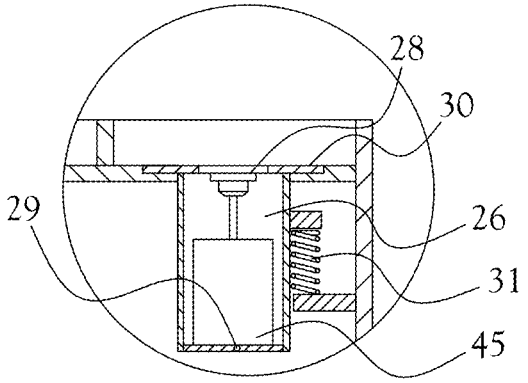
Figure 2D:
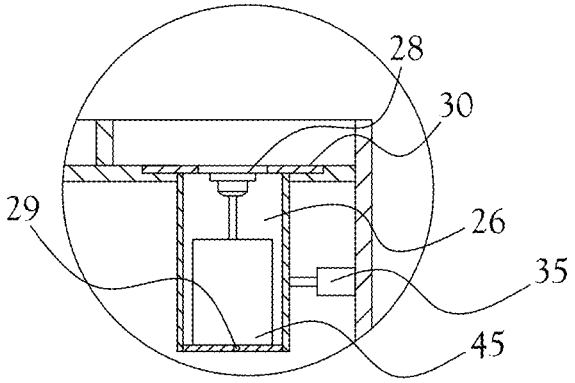

FIGS. 2A-2D illustrate example embodiments of a fire fixture for use with the hot tub illustrated in FIG. 1. In FIGS. 2A-2D, the fire fixture 24 may be the same as, or substantially similar to, those provided in the hot tub 10 illustrated in FIG. 1, but various example embodiments of the present general inventive concept may provide a variety of differently configured fire fixtures. As illustrated in FIGS. 2A-2D, the fire fixture 24 provided to the hot tub 10 illustrated in FIG. 1 has a fire producing portion 28 surrounded by a substantially round upper area 30 extending away from the fire producing portion 28, and a base 26 that extends downward into the body of the hot tub 10. In various example embodiments of the present general inventive concept, the base 26 may be configured with a fuel reservoir 45 therein, and/or a coupling mechanism 29 to couple the fire fixture 24 to a fuel line 27 to provide fuel to the fire fixture 24. Such fuel couplings may be the same as those well known in the art, such a fuel petcock valve, etc., and would be well known to those skilled in the art, and as such are not illustrated or described further herein. Such a configuration may prevent unwanted movement of the fire fixture 24, while also providing a large enough fuel reservoir inside the fire fixture 24 to extend the user's enjoyment of the produced flames. FIG. 2D illustrates an example embodiment in which an automatic gear 35 is used to adjust the height of the fire fixture 24, which is raised above the surface of the basin 12 in which the receiving portion 25 is formed. The motorized automatic gear 35 may be actuated to move the fire fixture 24 up and down according to a simple bidirectional control switch located on the basin 12 or housing 16, or according to a wireless electrical communication with a smart phone or remote control, and so on. In various example embodiments the automatic gear 35 assembly could be a motor driven gear wheel interacting with a rail attached to the base of the fire fixture. In various other example embodiments a telescoping driver could be coupled to the base, and so on. Such automated movements of bodies is well known, and not described in detail herein. A similar selectable height may be available in various example embodiments by configuring the receiving portion 25 to a size which produces a friction fit with the base 26 of the fire fixture 24 such that the friction fit overcomes the weight of the fire fixture 24, and the user can therefore manually move the fire fixture 24 up and down to a point that will be maintained by the friction fit. As illustrated in FIG. 2A, the fire fixture 24 may be selectively removable in various example embodiments, and a cover plate 33 (illustrated in FIG. 2C) or other such cover member may be placed over the receiving portion 25 to cover the receiving portion in the absence of the fire fixture 24. In various example embodiments such a cover plate 33 may be used to cover the fire fixture 24 itself when the fire fixture is lowered below a surface of the basin 12, as illustrated in FIG. 2C.

Figure 3:
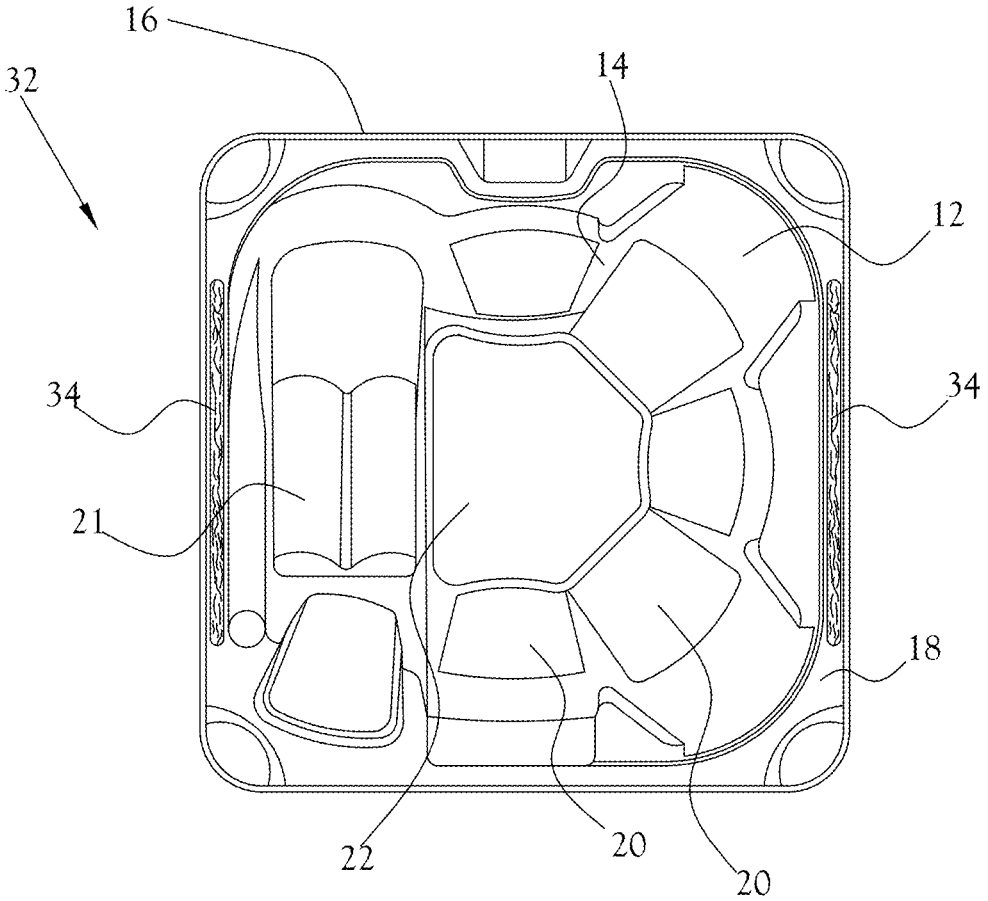
FIG. 3 illustrates a hot tub provided with fire fixtures according to another example embodiment of the present general inventive concept.

FIG. 3 illustrates a hot tub provided with fire fixtures according to another example embodiment of the present general inventive concept. In this example embodiment, a hot tub 32 is provided with elongated fire fixtures 34 that are arranged on opposite sides of the hot tub 32. In this example embodiment, one fire fixture 34 is provided along the side of the hot tub 34 near the reclining seat 21, and another fire fixture 34 is provided along the opposite side. Various example embodiments may provide only one fire fixture 34 along one side, or may provided such elongated fire fixtures 34 along three or four sides of the hot tub 34. Other example embodiments may provide different numbers of fire fixtures 34 having different shapes and configurations, such as one elongated fire fixture 34 along one side of the hot tub 32, with two small round fire fixtures 24 such as those illustrated in FIG. 1 placed on the opposite side or in the opposite corners.

The elongated fire fixtures 34 of FIG. 3 may be fixed in the hot tub 32, or may be retractable into the hot tub body 16 so as not to be seen when not in use. In various example embodiments, the fire fixtures 34 may be selectively removable, or may have selectively installable covers, and so on.

Figure 4:
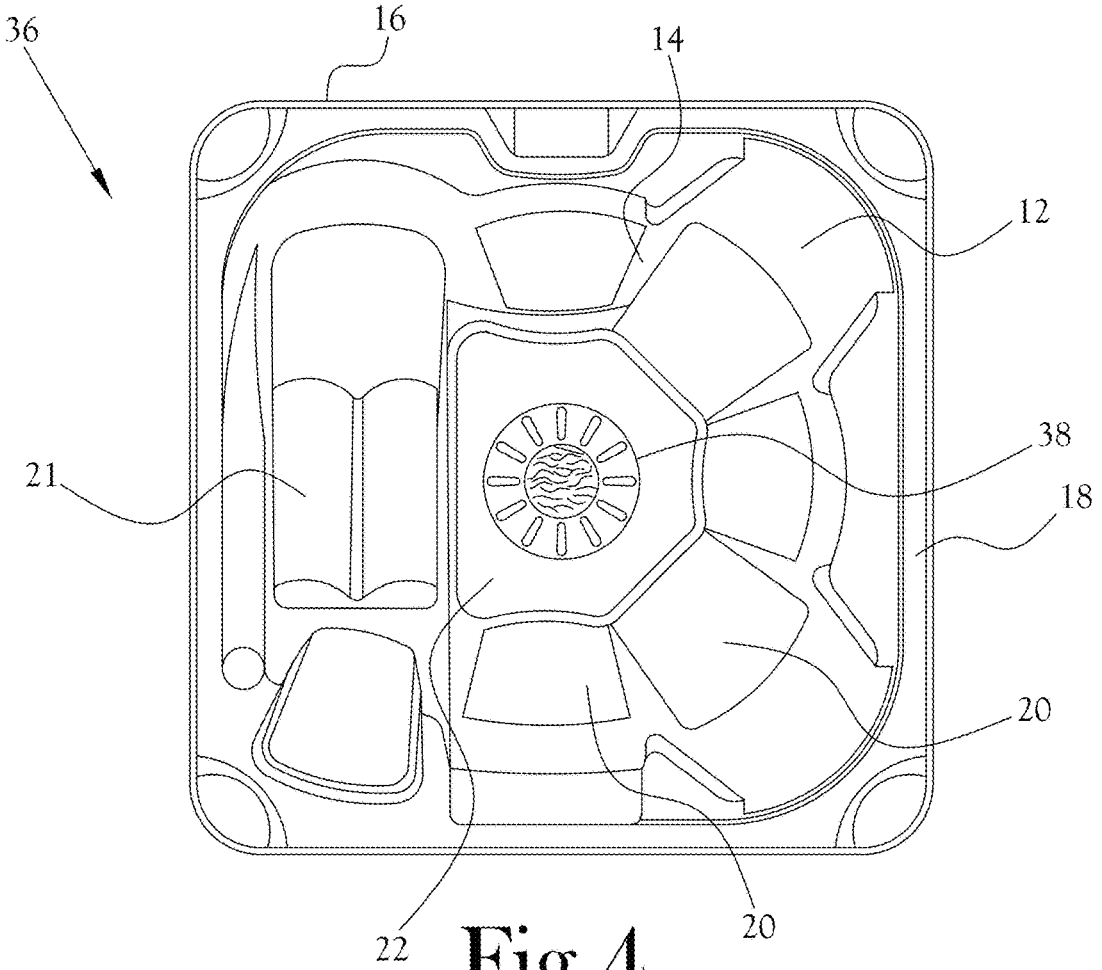
FIG. 4 illustrates a hot tub provided with a fire fixture according to yet another example embodiment of the present general inventive concept.
Figure 5:
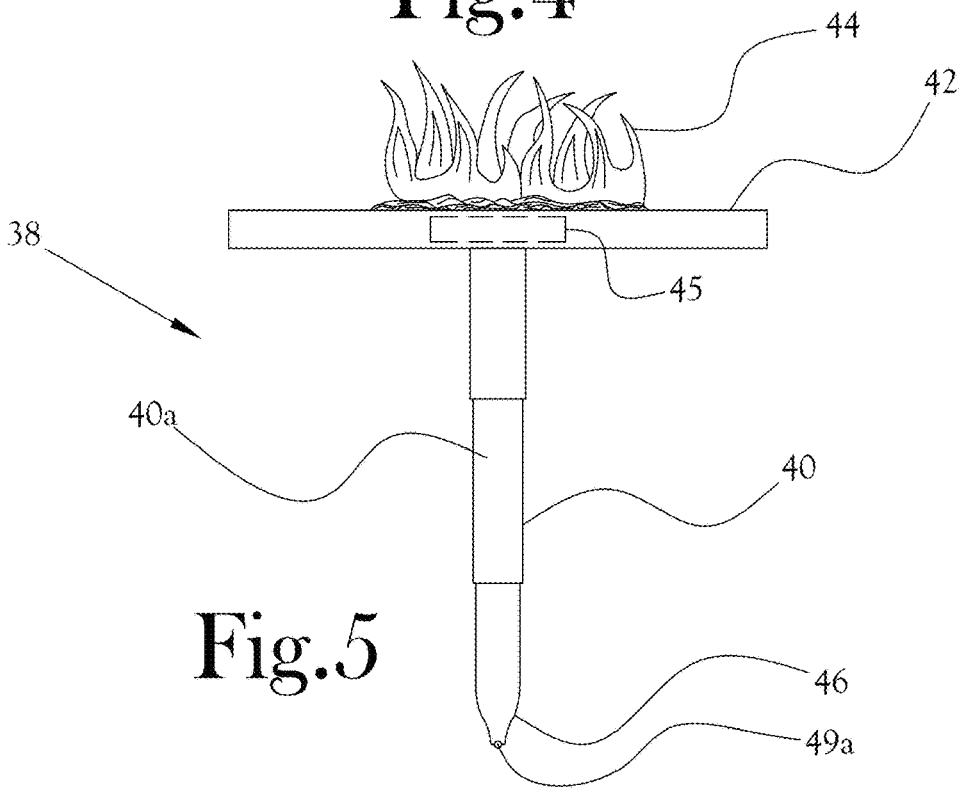
FIG. 5 illustrates an example embodiment of a fire fixture for use with the hot tub illustrated in FIG. 4.
Figure 6:
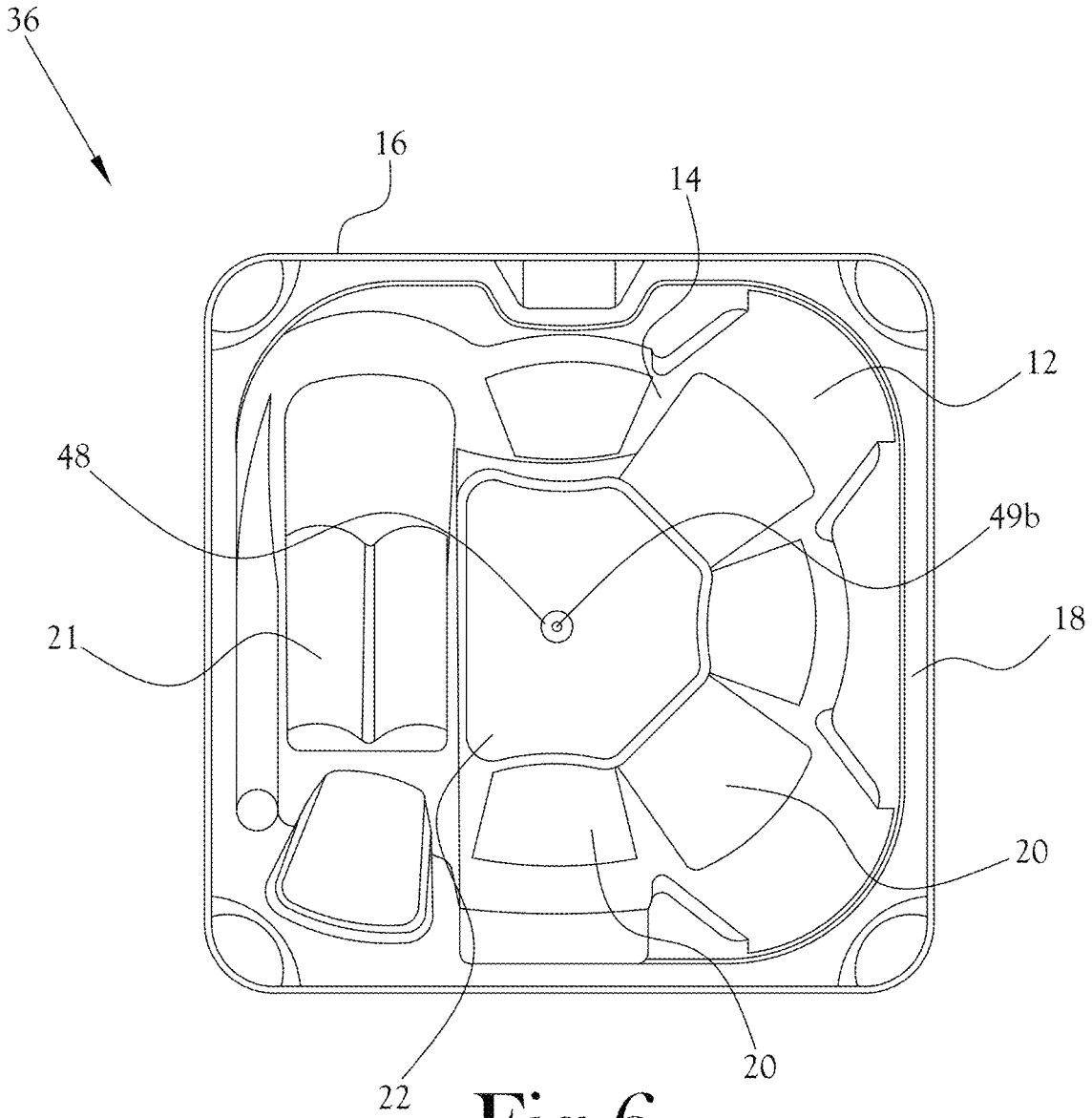
FIG. 6 illustrates the hot tub illustrated in FIG. 4 with the fire fixture removed.

FIG. 4 illustrates a hot tub provided with a fire fixture according to yet another example embodiment of the present general inventive concept. In the example embodiment illustrated in FIG. 4, a hot tub 36 is provided with a selectively removable fire fixture 38 that is installed so as to be located substantially in the middle of the hot tub 36. In other words, the flames produced by the fire fixture 38 may be faced by some or all of the users of the hot tub 36 as they are seated in the seats 20,21 formed in the hot tub basin 12. FIG. 5 illustrates an example embodiment of a fire fixture 38 for use with the hot tub 36 illustrated in FIG. 4, and FIG. 6 illustrates the hot tub 36 illustrated in FIG. 4 with the fire fixture 38 removed. As illustrated in FIG. 5, the removable fire fixture 38 is configured with a substantially round top horizontal surface 42 having a fire producing portion located substantially in the center of the top horizontal surface 42 for producing the flames, with a single leg 40 extending to the foor surface 22 of the hot tub basin 12 to secure the fire fixture 38 in place while preserving most of the leg/foot space for the users of the hot tub 36. Various other example embodiments of the present general inventive concept may provide more legs to provide a more secure installation, or one or more horizontal arms to be secured to the side of the basin or housing of the hot tub 36. Likewise, while the upper surface of the fire fixture 38 of this example embodiment is round, many other shapes and configurations may be provided according to the present general inventive concept.

In the example embodiment illustrated in FIGS. 4-6, the removable fire fixture 38 has a tapered bottom portion 46 that is configured to be placed into a fire fixture receiving portion 48 at the bottom of the hot tub basin 12, and may be secured with a simple friction fit configuration. Other example embodiments may provide a supplemental securing member, such as a sliding bolt, latch, etc., to prevent the fire fixture 38 from becoming inadvertently dislodged. In various example embodiments, the supporting leg 40 of the removable fire fixture 38 may be configured as a telescoping member 40*a* so that the height of the fire fixture 38 may be adjustable. Various example embodiments of the present general inventive concept may provide a fuel reservoir 45, or a watertight fuel nozzle connection 49*b*, or other such fuel connection, at the bottom of the fire fixture receiving portion 48 of the hot tub basin 12 to be connected to a fuel coupling 49*a* at the bottom portion 46 of the fire fixture 38 to provide fuel to the fire fixture 38 from a fuel storage in or near the hot tub 36, or from a location remote from the hot tub 36. The selectively removable fire fixture 38 is easily used simply as a table-top surface for drinks, etc., whether in use or not, when installed in the hot tub 36. Controls for all of the fire fixtures discussed herein may be provided on the fixtures themselves, or remotely from the fire fixtures, such as by a control pad/panel provided on the hot tub, a remote control, a smart phone app, etc.

Various example embodiments of the present general inventive concept may provide a method of constructing a hot tub having one or more fire fixtures provided thereto. For example, during the forming of the hot tub shell, fire fixture receiving portions may be formed such that fire fixtures may simply be removable installed therein. In other example embodiments, the fire fixture receiving portions may be formed in the housing surrounding the hot tub shell, and may be formed to be seen continuously, or to be retractable or otherwise coverable. In various example embodiments the fire fixture receiving portions can be fitted with fuel line couplings to provide fuel to the fire fixtures. In various example embodiments the fire fixture receiving portions may be formed to be mechanically movable to different heights, and/or to be hidden from view when the fire fixtures are not in use.

Various example embodiments of the present general inventive concept may provide a hot tub including hot tub including a hot tub basin with a plurality of seats formed therein, the hot tub basin configured to hold and recirculate water, a housing surrounding the hot tub basin, and one or more fire fixtures provided on an upper perimeter the hot tub basin to selectively produce open flame. The fire fixtures may be arranged in fire fixture receiving portions formed in the basin, and may be at an upper perimeter of the basin above and offset away from the water holing portion of the basin. In other words, the fire fixtures may be arranged at various points at a border of the water, so as to be removed or offset from the water area in which one or more people may be sitting. In other various example embodiments a selectively removable fire fixture may be provided that is installable so as to be located proximate a central location of the hot tub, such that the flame producing portion of the fire fixture is arranged above the surface of the water, and around which people may sit in the hot tub. Such a fire fixture may be configured to be selectively coupled to, and decoupled from, a receiving portion formed in the bottom of the hot tub basin, and may have a flat surface around the flame presenting portion to be a rest area for beverages and other items. In various example embodiments such a fire fixture could have a friction fit with the bottom portion of the basin, or may screw into the bottom portion of the basin, and so on.

Various example embodiments of the present general inventive concept may provide a hot tub including a hot tub basin with a plurality of seats formed therein, the hot tub basin configured to hold and recirculate water, a housing surrounding the hot tub basin, and one or more fire fixtures provided proximate an upper portion of the hot tub basin to selectively produce open flame. At least one of the one or more fire fixtures may be provided proximate a corner of the hot tub. At least one of the one or more fire fixtures may be provided along a side of the hot tub. The one or more fire fixtures may be selectively retractable into the housing of the hot tub so as to be hidden from sight when not producing fire. The one or more fire fixtures may be spring-loaded and movement regulated such that the fixtures may be retracted or protracted with a manual touch. The one or more fire fixtures may be provided with automated movement so as to be retracted or protracted with a control interface. At least one of the one or more fire fixtures may be configured to be selectively installed and removed from the basin of the hot tub. The hot tub may further include one or more fire fixture receiving portions configured to respectively receive the one or more fire fixtures. The one or more fire fixture receiving portions may be configured to respectively secure the one or more fire fixtures received therein with a friction fit. The hot tub may further include fire fixture receiving portion covers configured to cover the fire fixture receiving portions when fire fixtures are not received therein. The one or more fire fixture receiving portions may be configured such that a height of a fire fixture received therein is selectively adjustable. The one or more fire fixture receiving portions may be formed in an upper perimeter of the hot tub basin. The one or more fire fixture receiving portions may be formed in the housing. At least one of the one or more fire fixture receiving portions may be formed in the floor of the hot tub. At least one of the one or more fire fixtures may be configured with an upper surface and at least one lower support extending downward to be received in the one or more fire fixture receiving portions formed in the floor of the hot tub such that the upper surface rests above an upper level of water in the hot tub when installed. The hot tub may further include a fuel coupling provided in the one or fire fixture receiving portions formed in the floor of the hot tub to provide fuel to the fire fixture installed therein. The at least one lower support may be configured to be selectively adjustable in length such that a height of the fire fixture received in the one or more fire fixture receiving portions formed in the floor of the hot tub is adjustable. The one or more fire fixtures may be respectively configured with a fuel reservoir to store fuel therein. The hot tub may further include one or more fuel lines provided in the hot tub to provide fuel to the one or more fire fixtures, wherein the one or more fire fixtures are respectively provided with fuel line couplings configured to be respectively coupled to the one or more fuel lines. The fire fixtures may be fueled by ethanol.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A hot tub comprising:

a hot tub basin with a plurality of seats formed therein, the hot tub basin configured to hold and recirculate water;

a housing surrounding the hot tub basin; and one or more fire fixtures provided on an upper perimeter of the hot tub basin to selectively produce open flame.

2. A hot tub comprising:

a hot tub basin with a plurality of seats formed therein, the hot tub basin configured to hold and recirculate water;

a housing surrounding the hot tub basin;

one or more fire fixtures provided proximate an upper portion of the hot tub basin to selectively produce open flame, at least one of the one or more fire fixtures being configured to be selectively installed and removed from the basin of the hot tub; and one or more fire fixture receiving portions configured to respectively receive the one or more fire fixtures;

wherein the one or more fire fixture receiving portions are formed in an upper perimeter of the hot tub basin.

3. The hot tub of claim 2, wherein at least one of the one or more fire fixtures is provided proximate a corner of the hot tub.

4. The hot tub of claim 2, wherein at least one of the one or more fire fixtures is provided along a side of the hot tub.

5. The hot tub of claim 2, wherein the one or more fire fixtures are selectively retractable to a position under the basin of the hot tub so as to be hidden from sight when not producing fire.

6. The hot tub of claim 5, wherein the one or more fire fixtures are spring-loaded and movement regulated such that the fixtures may be retracted or protracted with a manual touch.

7. The hot tub of claim 5, wherein the one or more fire fixtures are provided with automated movement so as to be retracted or protracted with a control interface.

8. The hot tub of claim 2, wherein the one or more fire fixture receiving portions are configured to respectively secure the one or more fire fixtures received therein with a friction fit.

9. The hot tub of claim 2, further comprising fire fixture receiving portion covers configured to cover the fire fixture receiving portions when fire fixtures are not received therein.

10. The hot tub of claim 2, wherein the one or more fire fixture receiving portions are configured such that a height of a fire fixture received therein is selectively adjustable.

11. The hot tub of claim 2, wherein the one or more fire fixture receiving portions are formed in the housing.

12. The hot tub of claim 2, further comprising one or more fire fixture receiving portions are formed in the floor of the hot tub.

13. The hot tub of claim 12, wherein at least one of the one or more fire fixtures is configured with an upper surface and at least one lower support extending downward to be received in the one or more fire fixture receiving portions formed in the floor of the hot tub such that the upper surface rests above an upper level of water in the hot tub when installed.

14. The hot tub of claim 13, further comprising a fuel coupling provided in the one or fire fixture receiving portions formed in the floor of the hot tub to provide fuel to the fire fixture installed therein.

15. The hot tub of claim 13, wherein the at least one lower support is configured to be selectively adjustable in length such that a height of the fire fixture received in the one or more fire fixture receiving portions formed in the floor of the hot tub is adjustable.

16. The hot tub of claim 2, wherein the one or more fire fixtures are respectively configured with a fuel reservoir to store fuel therein.

17. The hot tub of claim 2, further comprising:

one or more fuel lines provided in the hot tub to provide fuel to the one or more fire fixtures;

wherein the one or more fire fixtures are respectively provided with fuel line couplings configured to be respectively coupled to the one or more fuel lines.

18. The hot tub of claim 2, wherein the fire fixtures are fueled by ethanol.

19. A hot tub comprising:

a hot tub basin with a plurality of seats formed therein, the hot tub basin configured to hold and recirculate water;

a housing surrounding the hot tub basin;

one or more fire fixtures provided proximate an upper portion of the hot tub basin to selectively produce open flame, at least one of the one or more fire fixtures being configured to be selectively installed and removed from the basin of the hot tub;

one or more fire fixture receiving portions configured to respectively receive the one or more fire fixtures; and one or more fire fixture receiving portion covers configured to cover the respective fire fixture receiving portions when fire fixtures are not received therein.

20. A hot tub comprising:

a hot tub basin with a plurality of seats formed therein, the hot tub basin configured to hold and recirculate water;

a housing surrounding the hot tub basin;

one or more fire fixtures provided proximate an upper portion of the hot tub basin to selectively produce open flame, at least one of the one or more fire fixtures being configured to be selectively installed and removed from the basin of the hot tub; and one or more fire fixture receiving portions configured to respectively receive the one or more fire fixtures;

wherein the one or more fire fixture receiving portions are formed in the housing.

21. A hot tub comprising:

a hot tub basin with a plurality of seats formed therein, the hot tub basin configured to hold and recirculate water;

a housing surrounding the hot tub basin; and one or more fire fixtures provided proximate an upper portion of the hot tub basin to selectively produce open flame;

wherein the one or more fire fixtures are selectively retractable to a position under the basin of the hot tub so as to be hidden from sight when not producing fire.

* * * * *